US007029011B2

(12) United States Patent
Strong et al.

(10) Patent No.: US 7,029,011 B2
(45) Date of Patent: Apr. 18, 2006

(54) METHOD OF AND APPARATUS FOR PLAYING A CARD GAME

(76) Inventors: Dennis Ray Strong, 3086 Racetrack Rd., D'Iberville, MS (US) 39540; Charles Eugene Sellers, 938 Main St., Shipley, FL (US) 32428

( * ) Notice: Subject to any disclaimer, the term of this patent is extended or adjusted under 35 U.S.C. 154(b) by 69 days.

(21) Appl. No.: 10/882,805

(22) Filed: Jun. 30, 2004

(65) Prior Publication Data

US 2006/0001216 A1 Jan. 5, 2006

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 5,845,906 A * 12/1998 Wirth ..... 273/274
6,113,101 A * 9/2000 Wirth ..... 273/274
6,808,173 B1 * 10/2004 Snow ..... 273/292
6,874,786 B1 * 4/2005 Bruno et al. ..... 273/306
6,938,900 B1 * 9/2005 Snow ..... 273/292
2004/0061288 A1 * 4/2004 Snow ..... 273/274
2004/0070146 A1 * 4/2004 Snow ..... 273/292
2004/0090005 A1 * 5/2004 Snow ..... 273/292
2005/0012273 A1 * 1/2005 Bruno et al. ..... 273/292
2005/0051958 A1 * 3/2005 Snow ..... 273/274
2005/0051960 A1 * 3/2005 Snow ..... 273/274

* cited by examiner

*Primary Examiner*—Benjamin H. Layno
*Assistant Examiner*—Dolores Collins
(74) *Attorney, Agent, or Firm*—Terry B. Morris

(57) ABSTRACT

The present invention provides a game that uses a standard deck of cards and enables play in several poker activities at once. The invention provides a method of playing Poker games that allows a player to have an interest in a current game even after folding his hand. This is achieved in part by a method of playing a card game played with a standard deck of fifty-two cards by two to seven original players, comprising a first step of each player posting a first wager and a second wager. At least a portion of this first wager is allocated to a jackpot fund wherein after all remaining river players have selected said declared hands, the following awards are distributed:

(1) wagers are awarded to the remaining river player(s) holding the winning declared hand(s) in accord with a standard poker rank;

(2) a bonus pay is awarded to each of said remaining river player(s) in accord with a scale; and (3) a jack pot is awarded to all remaining river player(s) if two or more players declared hands equal to or exceed a set jackpot rank.

18 Claims, 1 Drawing Sheet

METHOD OF AND APPARATUS FOR PLAYING A CARD GAME

FIELD OF THE INVENTION

The present invention relates to the field of card games, and more particularly to a card game that may be played live in person or through remote means, such as audio and/or visual connections or the internet.

BACKGROUND OF THE INVENTION

Poker is one of the oldest gambling card games in America. In recent years there have been considerable variations and improvements in games. In addition to the new games, new technology is taking advantage of the interest in poker. For example, video poker machines, which may use standard poker or a variation of it, are taking up the casino space previously occupied by old "one armed bandits" or multi-reel slot machines. All of the foregoing attests to the popularity of, and interest in, poker.

In modern casinos the game of Poker takes several forms. One is live or card room Poker where players compete against one another but the games are controlled and supervised by a house dealer who removes a house levy either in the form of a participation fee or as a percentage of winning hands. Another form is electronic video machines offering various forms of Poker. Yet another, among others, is played as a "banker's game" either where the game involves players in contest with the dealer's hand or where the object is for the players to obtain a hand based on hierarchical Poker rankings. In some versions of Banker games the house enjoys a favorable advantage based on a pay table that is structured in such a way that the pay-offs are not based on the true mathematical odds, or rules of play so structured that the house has a favorable edge.

There are numerous forms of Poker. Popular versions are Draw Poker, in which all of a player's cards are unknown to his opponents, and Stud Poker, in which some of the player's cards are face up and others face down. Within the above two broad categories numerous variations exist with "Holdem" or "Texas Holdem" being a popular example. In one "Holdem" variation, each player makes an ante wager and is dealt two cards face down and a betting interval ensues. In another variation, no ante wagers is made, but forced initial betting (e.g., "small blind" and "large blind") is required of two or more players. In a typical betting round, a player may pass or may make the initial wager. Once a bet (wager) has been made by a player (or a "blind" wager made), other players may call the bet, raise the bet, or fold the hand. The betting continues until there are no further raises, and all players have either called the last bet or folded. After the betting interval three community cards are dealt face up. A second betting interval follows and the dealer then turns up one more communal card. Another betting round follows after which the dealer turns up the final communal card and the player with the highest Poker ranked hand assembled from their own cards and the four communal cards wins the pot. Some variations may require use of one face down card (e.g., "hole card"). The winner is the player who achieves the highest hand according to standard poker rankings: royal flush, straight flush, four of a kind, full house, flush, straight, three of a kind, two pair, one pair, high card. The winner takes the pot.

Various patents disclose further variations to traditional forms of Texas Holdem Poker. U.S. Pat. No. 5,382,025 discloses a modification of Texas Holdem whereby players do not compete against one another and whereby players have the opportunity to select their two card hand from a plurality of hands dealt face-up. U.S. Pat. No. 5,417,430 discloses a Poker banker game in which the players place three bets at the outset but as the game unfolds the players are given the option of withdrawing two of their wagers. U.S. Pat. No. 5,494,295 discloses an invention which provides a method whereby a plurality of hand ranking rules can be utilized within a single type wagering game.

It is to be noted that Poker in casinos (excluding video style machines) often takes two distinct forms and method of operation. In a card room Poker, players compete against one another. In a banking type Poker game, players do not compete against one another but against the house either in terms of competing with a dealer or where there is no dealer hand and the object is to reach certain winning combinations. There is a need for a game method where players both compete against one another and against the house and where they have the opportunity to receive bonus payments by achieving certain winning Poker hands/combinations.

With reference to electronic, video casino games, Video Draw Poker is widely played. In a version of Video Draw Poker, a player places a wager of 1–5 units and a hand of five cards composed of electronically produced visual representation are displayed on a monitor. The player has the option of discarding some or all of the cards and receiving replacements which are selected by the machine's processor from memory. If the player's hand corresponds to one of the hands based on Poker ranking he wins the corresponding award displayed on the pay table. The award is multiplied by the number of units bet. Video Draw Poker can appear in a progressive jackpot form where a player qualifies for the progressive jackpot provided he wagers the maximum number of units permissible (usually 5).

While games such as the above described game of Texas Holdem are popular, there are a number of drawbacks. One problem for commercial gaming establishments is that the game is player versus player, as opposed to player versus the house. This means that the house must collect a percentage of the pot to make a profit. Because each hand can take a considerable amount of time, given the number of betting rounds and the time inherent in bluffing, attempting to "read" other players, and so on, the profit margin for the house is limited. In addition, many would-be customers are simply too intimidated to play against other players, especially in light of the fact that the other players may be professional card players with considerable experience.

What is needed is a game that may be based on poker, particularly a Texas Holdem type game, but that may be played in a manner to maintain players' interests yet still be basic or "player friendly". It is further desirable that player actions have acceptable turnaround time per hand to allow for improved profit margin. It is further desirable that the game is not intimidating to new or inexperienced players. It is further desirable that the game maintains some elements of successive betting and has a method of play and payout structure that maintains player interest.

SUMMARY OF THE INVENTION

The present invention provides a game that uses, in one preferred embodiment, a standard deck of cards, and enables play in several poker activities at once. In one embodiment each player's hand comprises one or more individual cards, together with one or more common cards.

It is an object of the present invention to provide an enjoyable card game.

It is a further object of the present invention to provide a method of playing Poker games that allows a player to have an interest in a current game even after folding his hand.

It is a further object of the present invention to provide a game that will be familiar to current Poker players and easy for them to learn.

It is a further object of the present invention to provide a game that could be played in a table game or as a computer game.

The embodiments of the present invention may provide one or more advantages including providing a new and challenging form of gaming entertainment to casino customers; providing a form of poker that may be played live, in person, or by video or internet. The embodiments of the present invention may provide a means for maintaining players' interests so that the house may achieve an acceptable return; and providing a form of poker that can attract new players.

The foregoing and other benefits of the inventions will become apparent from the present specification.

DESCRIPTION OF PREFERRED EMBODIMENTS

Figure 1:
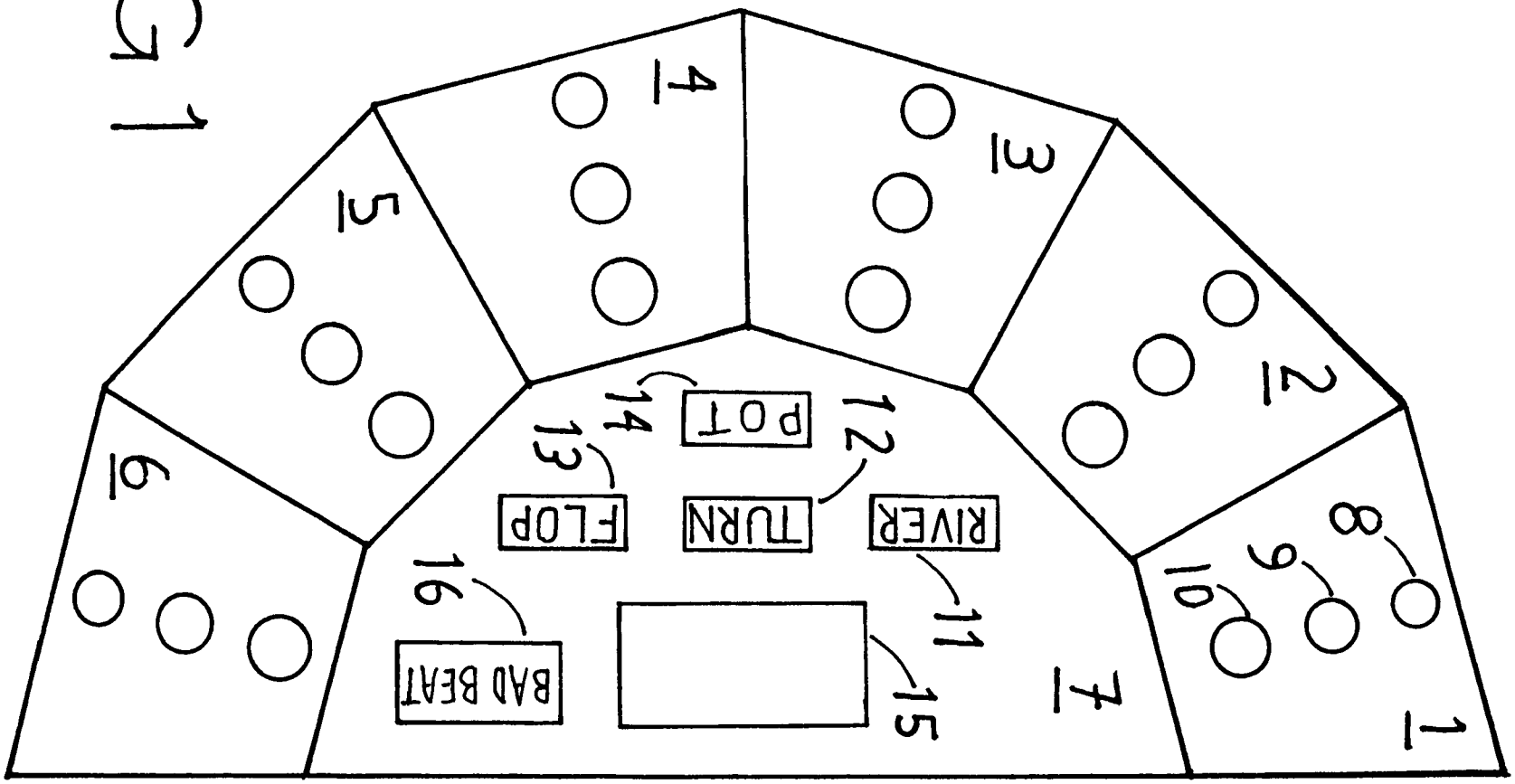
FIG. 1 is a depiction of a playing surface suitable for use with one embodiment of the present invention.

In a preferred embodiment, the present invention is a method of playing a card game played with a standard deck of fifty-two cards by two to seven original players. In a first step each player posts a first wager and a second wager. At least a portion of this first wager is allocated to a jackpot fund. This jackpot fund may be used in the jackpot play hereinafter described. However, a portion of this first wager may be used for other optional purposes. For instance, a portion of the wager may be reserved for use in later jackpot play or may be allocated as a handling fee by an administrator of the game. The second wager is allocated as a bet in a bonus game, hereinafter described.

Then each player is dealt one or two hole card(s), preferably two, from the deck and subsequently each player elects one of the following two steps:

(1) folds his hand and forfeits the first and second wagers of the player; or (2) posts a third wager of a set amount and continues play in the hand as a remaining player in the next round of play, typically called the "flop" round. Although in this or a following step a player may fold his hand, he stills has a potential stake in the subsequent outcome of the hereinafter described jackpot play based upon other players' hands. For convenience in this description, remaining players in the game at this point are termed "flop players".

In the next, flop round of play, one to three card(s), preferably three, are dealt face up, e.g. "flopped". Since they are dealt face up and in a location common to all players, these cards are community, or communal, cards, which each remaining player can select for use as card(s) in their hand of play by indicating such later in the game when announcing their individual hands. These cards are not picked up though by any player, but remain on the playing surface. Such selection does not prevent other players from also selecting such community card for use in their own hand of play. In this manner, each of the remaining flop players is dealt effectively a first set of community card(s), which cards are subject to share by other players. Prior to the dealing of the flop card(s), the dealer of the cards may, as predetermined as an option, "burn" (e.g. discard from play face down) a card from the top of the deck of cards. Such burn of a card is a typical, well-know play technique in card games. Subsequent to the community flop deal, each remaining flop player elects one of the following two steps:

(1) folds his hand and forfeits said first, second and third wagers of said flop player; or (2) posts a fourth wager of a set amount and continues play in the hand as a remaining player in the next round of play, typically called the "turn" round. These remaining players are termed herein as "turn" players.

In the turn round of play, one to three, preferably one, community card(s) is/are dealt on the play surface. Prior to the turn community deal, a top card may be burnt if this option is in effect. Each remaining turn player is thereby effectively dealt a second set of community card(s) and subsequently each remaining turn player elects one of the following two steps:

(1) folds his hand and forfeits the first, second, third and fourth wagers of the turn player; or (2) posts a fifth wager of a set amount and remains in the hand as a remaining "river" player.

In the river round of play, a third set of one to three, preferably one, community card(s) is/are dealt on the play surface. Prior to this community deal, a top card may be burnt if this option is in effect. Then each remaining river player selects five cards from the remaining river player's hole card(s) and the first, second and third sets of community cards. The five cards selected will be that players declared hands when so announced. Preferably, the rule of the game requires that the five cards including at least one of that remaining river player's hole card(s) to establish that remaining river player's declared hand. After all remaining river players have selected and announced their respective declared hands, the following awards are distributed.

In one award, all of the collective third, fourth and fifth wagers are awarded to the remaining river player(s) holding the winning declared hand(s) in accord with a standard poker rank, which includes equal sharing for tied top hands.

In another award, the first jack pot is awarded to all original player(s) if two or more players declared hands from the river round are equal to or exceed a set jackpot rank, preferably aces full or better. The first jackpot is preferably distributed in a manner such that a greatest portion of the first jackpot is given to the remaining river player having the second highest declared hand, a next greatest portion of the first jackpot is given to the remaining river player having the highest declared hand, and the remaining portion of the first jackpot is distributed among the other original river player(s), which includes those which folded earlier in the play. If two or more players declared hands do not equal to or exceed a set jackpot rank, at least a portion of the first jackpot is forfeited to the house. In a preferred distribution, one half of the jackpot is given to the remaining river player having the second highest declared hand, one quarter of the first jackpot is given to the remaining river player having the highest declared hand, and the remaining portion of the first jackpot is distributed among the other original river player(s), which includes those which folded earlier in the play.

In another award, a bonus pay is awarded to each of the remaining river player(s) in accord with a scale determined from the declared hand of each remaining river player and the second wager of such remaining river player. The values may range as a matter of the discretion of the house.

Although the reward will generally be scaled to the probability of success, it need not be. A non-limiting scale is exemplified below.

| | |
|---|---|
| Three of a Kind | 1 to 1 |
| Straight | 2 to 1 |
| Flush | 3 to 1 |
| Full House | 7 to 1 |
| Four of a Kind | 40 to 1 |
| Straight Flush | 500 to 1 |
| Royal Flush | 1000 to 1 |

Variations are possible in the practice of the present invention. For instance, while dealing and betting are each preferably circular, more preferable in a clockwise fashion, other dealing or betting patterns are possible. For instance such can be done in a crossing or skipping pattern, even varied for each round of play. Options are also present in a house take of the wagers, such as a gaming establishment which receives a portion of one or more wager(s) selected from a set consisting of first, second, third, fourth and fifth wagers. Also, a second portion of the first wager can be allocated to a reserve allocated to a second jackpot for use in another first jackpot in a subsequent game. Other embodiments include the invention played with a high-low split as a component of the hand rank or played with one or more wild card(s).

A preferred embodiment includes play of the game on the surface disclosed in FIG. 1.

Play of the present invention is illustrated in Example 1 in a non-limiting practice of the game.

EXAMPLE 1

A casino house operates an embodiment of the present invention, entitling it "MISSISSIPPI HOLD'EM" card game, played with two to six players on the play surface disclosed in FIG. 1. The dealer stands to the right of surface 7 near chip rack 15 as portrayed in FIG. 1. The players stand generally opposite the dealer, each respectively behind the player sections 1 through 6. Each player section 1 through 6 has its own sets of betting circles for the receipt of wagers, designated as Ante Circle, Pot Beat Circle, and Bad Beat Circle, respectively circles 8, 9, and 10 in player section 1, and similarly designated for the unnumbered circles in the corresponding player sections 2 through 6. Betting circles Ante Circle, Pot Beat Circle, and Bad Beat Circle may be identified as desired by the casino house, such as by appropriate labels in or near the relevant circle. Each player will be dealt clockwise, beginning with the player at player section 6 left of the designated dealer. A dealer marker moves from player to player in a clockwise manner after each game so that each player has a turn in the dealer position, although a house dealer is present to actually distribute the cards from a deck. The game starts and each player makes an Ante Bet of $5 to $50 into the ANTE circle in front of his position, such as circle 8 for the player at player section 1, and posts a $1 Bad Beat fee in the BAD BEAT circle in front of his position, such as circle 10 for the player at player section 1. The Ante Bet remains in each respective ANTE circle and is used to play against the Bonus Play Scale, which can be conveniently posted for viewing by all at the table and is displayed below. The Bad Beat fees are collected by the house with 10% to be collected by the house, 60% is placed into the Active Jackpot for this hand, and 30% goes into a Reserve Jackpot which replaces the Active Jackpot when it is collected. The Active Jackpot is kept in the BAD BEAT rectangle, rectangle 16 on the surface displayed in FIG. 1, until collected.

Each player is dealt two hole cards, face down, which he is allowed to view. Players who elect to stay in the play then post a $5 wager into the POT BET circle in front of their position, such as circle 9 for the player at player section 1. Players who do not post a POT BET wager yield their hole cards to the table and are no longer in the play. The house dealer collects all POT BET wagers into the POT rectangle (rectangle 14) near the table center and burns the top card of the deck. The house dealer then deals for the players staying in the play three community cards, face up, as the flop cards in the FLOP rectangle, rectangle 13, near the table center. Players who elect to stay in then each posts an additional $5 wager into the POT BET circle in front of their position. Players who do not post a second POT BET wager yield their hole cards to the table and are no longer in the play. The house dealer collects all POT BET wagers into the POT rectangle near the table center and burns the top card of the deck. The house dealer then deals one community card, face up, as the turn card in the TURN rectangle, rectangle 12, near the table center. Players who elect to stay in then post another additional $5 wager into the POT BET circle in front of their position. Players who do not post a POT BET wager yield their hole cards to the table and are no longer in play. The house dealer collects all POT BET wagers into the POT rectangle near the table center and burns the top card of the deck. The house dealer then deals one last community card, face up, as the river card in the RIVER rectangle, rectangle 11, near the table center. The dealer then turns up all hole cards in play. A player must use one or both hole cards and fill the balance of his five card hand with community cards and the hands are ranked in accord with traditional poker hand rankings. The winning hand wins the POT (tie winning hands equally share the POT). The house earns a 5% cut of the POT limited by a $3 maximum cut. The Ante Bet for each player is played according to the Bonus Pay Scale below. The Ante Bet for a player who does not have three of a kind or better is forfeited to the house.

Bonus Pay Scale

| Hand Played | Pay Out Ratio to Ante Bet |
|---|---|
| Three of a Kind | 1 to 1 |
| Straight | 2 to 1 |
| Flush | 3 to 1 |
| Full House | 7 to 1 |
| Four of a Kind | 40 to 1 |
| Straight Flush | 500 to 1 |
| Royal Flush | 1000 to 1 |

The Active Jackpot is paid out if a player holding Aces Full or better is beaten. In that event, the player of the beaten hand is paid 50% of the of the Active Jackpot, the player of the winning hand is paid 25% of the Active Jackpot, and all other players, including those of folded hands, equally share the balance of the Active Jackpot.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A method of playing a card game played with a deck of cards by two to seven original players, comprising the steps of:

(a) each said player posts a first wager and a second wager, wherein at least a first portion of said first wager is allocated to a first jackpot and wherein said second wager is allocated as a bet in a bonus game;

(b) then each said player is dealt one or more hole card(s) from said deck and subsequently each player elects one of the following two steps:

(1) folds his hand and forfeits said first and second wagers of said player; or (2) posts a third wager of a set amount and continues play in the hand as a remaining flop player;

(c) then each said remaining flop player is dealt a first set of one to three community card(s) from said deck and subsequently each remaining flop player elects one of the following two steps:

(1) folds his hand and forfeits said first, second and third wagers of said flop player; or (2) posts a fourth wager of a set amount and remains in the hand as a remaining turn player;

(d) then each said remaining turn player is dealt a second set of one to three community card(s) from said deck and subsequently each remaining turn player elects one of the following two steps:

(1) folds his hand and forfeits said first, second, third and fourth wagers of said turn player; or (2) posts a fifth wager of a set amount and remains in the hand as a remaining river player;

(e) then each said remaining river player is dealt a third set of one or more community card(s) from said deck; and (f) then each remaining river player selects five cards from said remaining river player's hole card(s) and said first, second and third sets of community cards, said five cards including at least one of that remaining river player's said hole card(s), to establish that remaining river player's declared hand;

wherein after all remaining river players have selected said declared hands, the following awards are distributed:

(1) all of said third, fourth and fifth wagers are awarded to the remaining river player(s) holding the winning declared hand(s) in accord with a standard poker rank;

(2) a bonus pay is awarded to each of said remaining river player(s) in accord with a scale determined from said declared hand of said remaining river player and said second wager of said remaining river player; and (3) said first jack pot is awarded to all remaining river player(s) if two or more players declared hands equal to or exceed a set jackpot rank, said first jackpot being distributed in a manner such that a greatest portion of said first jackpot is given to the remaining river player having the second highest declared hand, a next greatest portion of said first jackpot is given to the remaining river player having the highest declared hand, and the remaining portion of said first jackpot is distributed among the other said original river player(s); and, if two or more players declared hands do not equal to or exceed a set jackpot rank, at least a portion of said first jackpot is forfeited.

2. The method of claim 1 wherein said cards are dealt in a circular fashion.

3. The method of claim 1 wherein the number of said hole card(s) is two.

4. The method of claim 1 wherein the number of cards in said first set of community cards is three.

5. The method of claim 1 wherein the number of cards in said second set of community cards is one.

6. The method of claim 1 wherein the number of cards in said third set of community cards is one.

7. The method of claim 1 wherein the number of said hole card(s) is two, the number of cards in said first set of community cards is three, the number of cards in said second set of community cards is one, and the number of cards in said third set of community cards is one.

8. The method of claim 1 wherein said scale awards declared hands of three of a kind or better.

9. The method of claim 8 wherein said scale awards in accord with the following table:

| | |
|---|---|
| Three of a Kind | 1 to 1 |
| Straight | 2 to 1 |
| Flush | 3 to 1 |
| Full House | 7 to 1 |
| Four of a Kind | 40 to 1 |
| Straight Flush | 500 to 1 |
| Royal Flush | 1000 to 1. |

.

10. The method of claim 1 wherein said set jackpot rank is Aces Full or better.

11. The method of claim 1 practiced in a gaming establishment which receives a portion of one or more wager(s) selected from a set consisting of first, second, third, fourth and fifth wagers.

12. The method of claim 1 wherein a second portion of said first wager is allocated to a reserve allocated to a second jackpot for use in another first jackpot in a subsequent game.

13. The method of claim 10 wherein said jackpot being distributed in a manner such that fifty percent of said first jackpot is given to the remaining river player having the second highest declared hand, twenty-five percent of said first jackpot is given to the remaining river player having the highest declared hand, and the remaining twenty-five percent of said first jackpot is distributed among the other said original player(s).

14. The method of claim 1 played on a surface as depicted in FIG. 1.

15. The method of claim 1 played with a high-low split as a component of said standard rank.

16. The method of claim 1 played with one or more wild card(s).

17. The method of claim 1 wherein one or more card(s) are burned prior to dealing of one or more of said first, second and third community cards.

18. A method of playing a card game played with a deck of cards by two to seven original players, comprising the steps of:

(a) each said player posts a first wager and a second wager, wherein at least a first portion of said first wager is allocated to a first jackpot and wherein said second wager is allocated as a bet in a bonus game;

(b) then each said player is dealt two hole card(s) from said deck and subsequently each player elects one of the following two steps:

(1) folds his hand and forfeits said first and second wagers of said player; or (2) posts a third wager of a set amount and continues play in the hand as a remaining flop player;

(c) then the top card of said deck is burnt and each said remaining flop player is dealt a first set of three community cards and subsequently each remaining flop player elects one of the following two steps:

(1) folds his hand and forfeits said first, second and third wagers of said flop player; or (2) posts a fourth wager of a set amount and remains in the hand as a remaining turn player;

(d) then the top card of said deck is burnt and each said remaining turn player is dealt a second set of one community card and subsequently each remaining turn player elects one of the following two steps:

(1) folds his hand and forfeits said first, second, third and fourth wagers of said turn player; or (2) posts a fifth wager of a set amount and remains in the hand as a remaining river player;

(e) then the top card of said deck is burnt and each said remaining river player is dealt a third set of one community card; and (f) then each remaining river player selects five cards from said remaining river player's hole card(s) and said first, second and third sets of community cards, said five cards including at least one of that remaining river player's said hole card(s), to establish that remaining river player's declared hand;

wherein after all remaining river players have selected said declared hands, the following awards are distributed:

(1) all of said third, fourth and fifth wagers are awarded to the remaining river player(s) holding the winning declared hand(s) in accord with a standard poker rank;

(2) said first jack pot is awarded to all remaining river player(s) if two or more players declared hands equal to or exceed a set jackpot rank, said first jackpot being distributed in a manner such that a greatest portion of said first jackpot is given to the remaining river player having the second highest declared hand, a next greatest portion of said first jackpot is given to the remaining river player having the highest declared hand, and the remaining portion of said first jackpot is distributed among the other said original river player(s); and, if two or more players declared hands do not equal to or exceed a set jackpot rank, at least a portion of said first jackpot is forfeited; and (3) a bonus pay is awarded to each of said remaining river player(s) in accord with a scale determined from said declared hand of said remaining river player and said second wager of said remaining river player, said table being:

| | |
|---|---|
| Three of a Kind | 1 to 1 |
| Straight | 2 to 1 |
| Flush | 3 to 1 |
| Full House | 7 to 1 |
| Four of a Kind | 40 to 1 |
| Straight Flush | 500 to 1 |
| Royal Flush | 1000 to 1 |

* * * * *